United States Patent [19]

Pfarrwaller

[11] 4,223,703

[45] Sep. 23, 1980

[54] PICKING MECHANISM FOR A SHUTTLE OF A WEAVING MACHINE

[75] Inventor: Erwin Pfarrwaller, Winterthur, Switzerland

[73] Assignee: Sulzer Brothers Limited, Winterthur, Switzerland

[21] Appl. No.: 934,474

[22] Filed: Aug. 17, 1978

[51] Int. Cl.[2] ..... D03D 49/32

[52] U.S. Cl. ..... 139/145; 74/54

[58] Field of Search ..... 139/142, 145, 439; 74/54, 84

[56] References Cited

U.S. PATENT DOCUMENTS

| | | | |
|---|---|---|---|
| 3,124,168 | 3/1964 | Wohlgemuth et al. | 139/145 |
| 3,274,838 | 9/1966 | Kelch | 74/54 |

*Primary Examiner*—Henry Jaudon

*Attorney, Agent, or Firm*—Kenyon & Kenyon

[57] ABSTRACT

A cam drive is used to control the picking movement of the picking lever. The cam drive includes a dam disc which has a recess (or projection) which causes the lever to accelerate at the beginning of a pick and thereafter imparts a prestress to the spring before the cam follower of the lever moves out of the cam disc recess. A dog clutch is used to permit movement of the cam disc relative to the uniformly rotating drive shaft.

15 Claims, 9 Drawing Figures

PICKING MECHANISM FOR A SHUTTLE OF A WEAVING MACHINE

This invention relates to a picking mechanism for a shuttle of a weaving machine.

Heretofore, various types of picking mechanisms have been known for picking a shuttle or the like of a weaving machine into a shed. In one known construction, for example as described in German Pat. No. 656,458, a picking lever is secured on a spring in the form of a torsion rod or bar and a crank drive with a clutch having a driving half and a driven half is used to drive the lever and spring. The operation of this mechanism is such that, during a pick, as the crank drive moves out of one dead-center position, the picking lever accelerates into a second dead-center position while the spring relaxes and a clearance forms in the clutch. In this construction, the spring cannot be tensioned with a controlled tensioning curve. Instead, the parts snap extremely rapidly through the second dead-center position into a stop position in which they remain until the driving half of the clutch catches up with them and they are then tensioned for the next pick.

Accordingly, it is an object of the invention to provide a picking mechanism wherein the stress in a spring for biasing a picking lever can be controlled.

It is another object of the invention to influence or control the relaxation of a picking lever spring of a picking mechanism after a pick.

It is another object of the invention to accelerate a shuttle at a relatively high rate of speed from a picking mechanism.

Briefly, the invention provides a picking mechanism for a shuttle of a weaving machine which includes a rocking or picking lever having a picking element mounted thereon for picking of a shuttle, a spring connected to the lever to bias the lever in a picking direction, a rotatable drive shaft, and a tensioning means for stressing the spring in a direction away from the picking direction. For the sake of simplicity, the conventional term "picking mechanism" is used to designate the acceleration mechanism.

The tensioning means is in the form of a cam drive and includes at least one freely rotatable cam disc mounted on the drive shaft and a unilaterally acting clutch having a driving half mounted on the drive shaft for rotation therewith and a driven half secured to the cam disc. These clutch halves are disposed in facing relation to each other. The cam disc has a series of cam sections in engagement with the lever for accelerating the movement of the lever in the picking direction under the bias of the spring during rotation of the shaft while forming a clearance between the clutch halves and for subsequently partially stressing the spring for a subsequent pick.

The accelerating and partially stressing cam sections may be formed as a depression or projection which forms a departure from a circular surface at the periphery of the cam disc which circular surface has a center at the center of the cam disc.

Thus, it is possible to influence or control the relaxation of the picking spring after the pick. The picking spring energy liberated during expansion can be converted into cam disc rotational energy, the clutch half (e.g. a driver) associated with the cam disc being able to lead over the driven half of the clutch (e.g. also a driver).

By using a cam disc, it is possible to devise the relaxation of the spring such that the rocking lever passes into a steeply descending depression of the cam disc as the pick begins. This results in a high acceleration of the shuttle or the like. The energy conversion can then be completed in a subsequent section of reduced gradient, whereupon a renewed partial tensioning of the spring can be obtained for the next pick by a partial rise on the cam. This partial rise may simply cover a height such that the rotational energy inherent in the cam disc is again completely converted to potential energy of the partially tensioned spring. In these conditions, the rocking lever can enter a self-locking section of the cam periphery. The cam disc cannot reverse.

Another advantage of a cam drive over a crank drive is that the time required for the energy exchange between the rocking lever (picking lever) and the cam disc can be adapted to requirements. The individual phases of the movement of the rocking lever within the operational clearances are variable both in time and form in the case of the cam drive, while they are constant in the case of the crank drive.

The peripheral surface of the cam disc may be shaped in any suitable fashion to initially prestress the spring, to accelerate the movement of the lever and to partially prestress the spring. Also, a non-return means can be utilized to prevent counter-rotation of the cam disc.

The spring can be in the form of a torsion bar which, in one embodiment, is mounted at one end for rotation in one direction while being held against rotation in the opposite direction.

In another embodiment, an arm is secured to the lever while a second cam disc is fixedly mounted relative to the first cam disc to engage the arm and hold the lever against the first cam disc.

These and other objects and advantages of the invention will become more apparent from the following detailed description taken in conjunction with the accompanying drawings in which.

Figure 1:
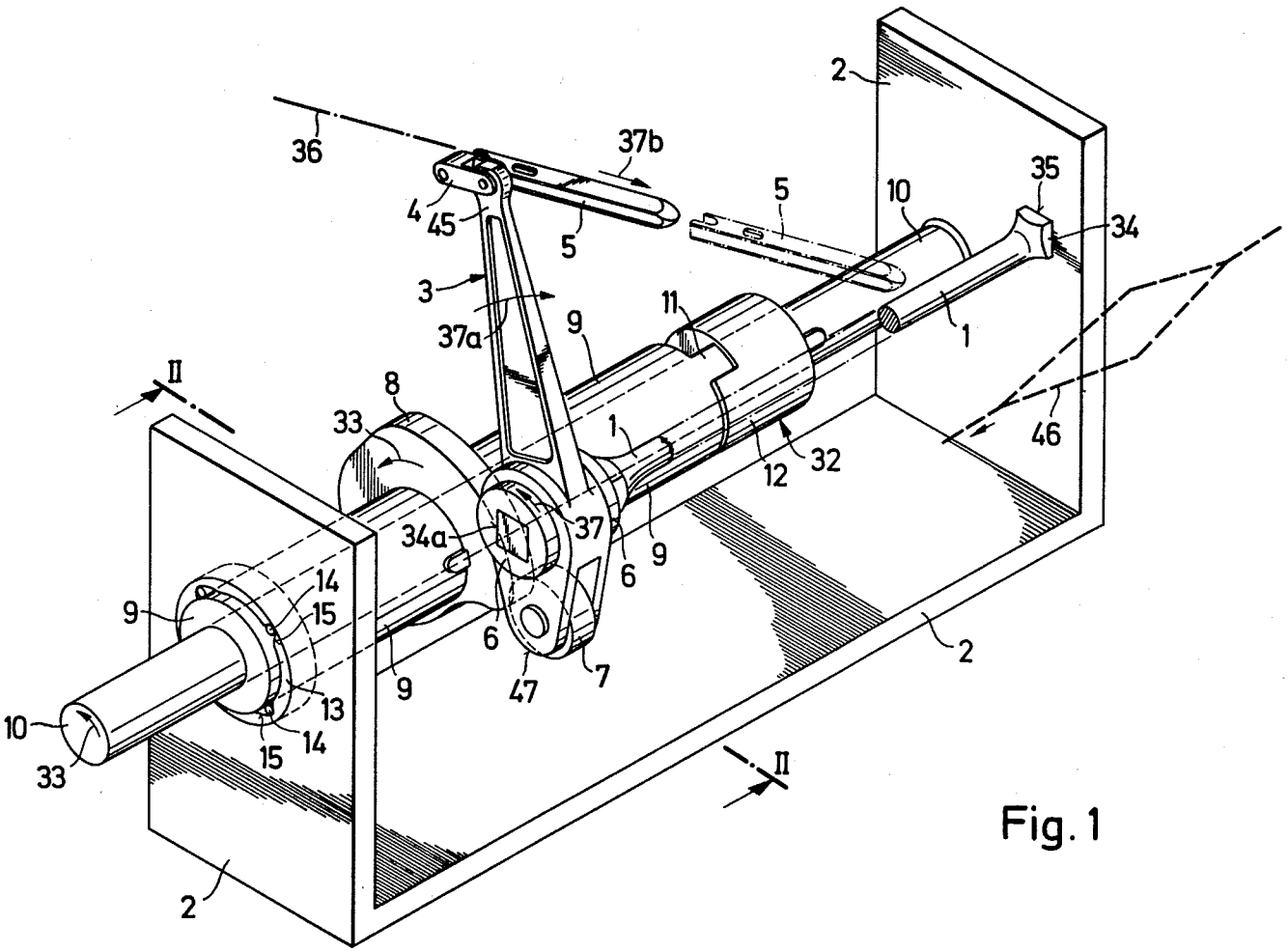
FIG. 1 illustrates a perspective view of a picking mechanism constructed according to the invention in a partially diagrammatic form.

Referring to FIG. 1, the picking mechanism for a weaving machine includes a spring in the form of a torsion bar 1 anchored at one end 35 in a frame 2. The ends 35 of the bar 1 are square shaped to provide flat surfaces 34*a*. This bar 1 is rotatably mounted by means of two bearing rings 6 in a bearing (not shown) disposed on the frame 2 and carries a picking or rocking lever 3 between the bearing rings 6. The lever 3 mounts a picking element 4 at one end 45 in pivotal relation for picking a shuttle 5 through a shed 46 during insertion of a weft 36 while the weft 36 is drawn after the shuttle 5. The opposite end 47 of the lever 3 carries a cam follower roller 7 for purposes as explained below.

Figure 2:
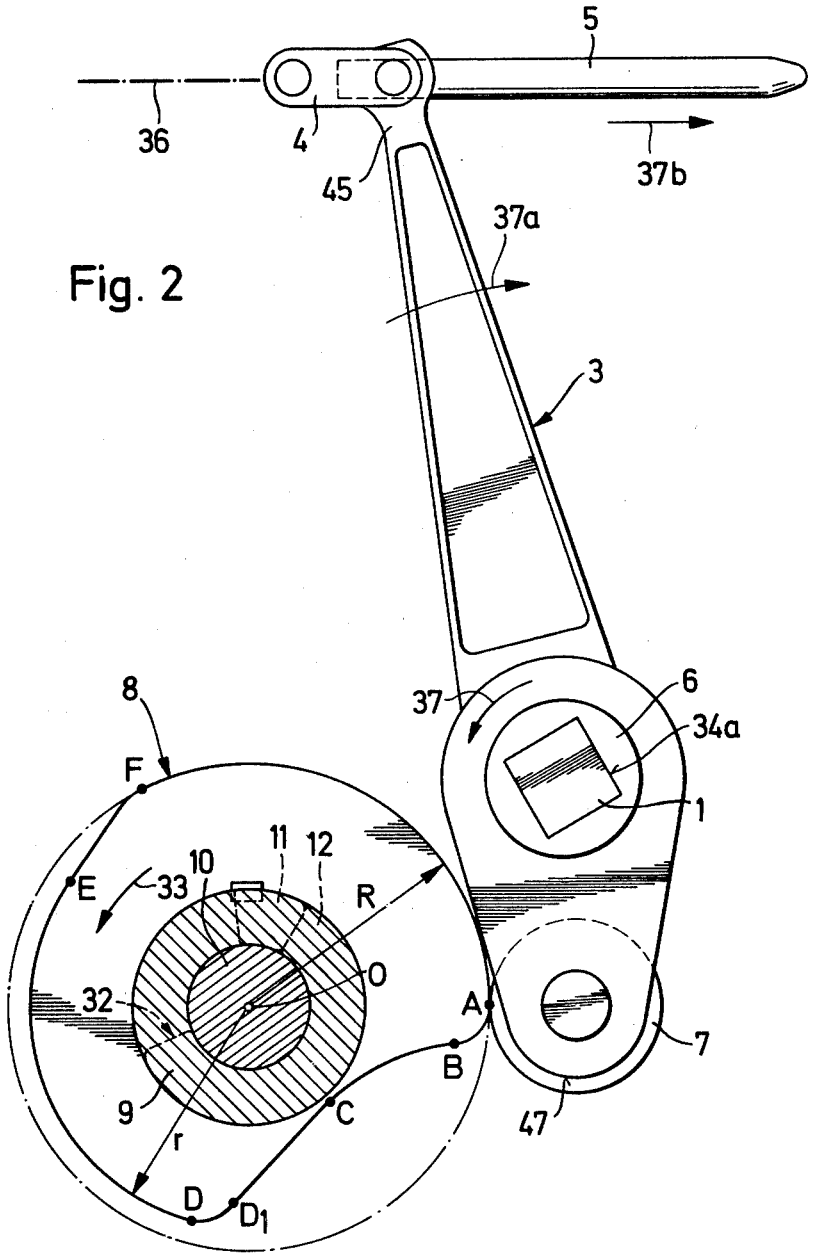
FIG. 2 illustrates a view taken on line II—II of FIG. 1.

The picking mechanism also has a drive shaft 10 which is rotatably mounted in the frame 2 and is continuously driven from the main shaft (not shown) of the weaving machine in the direction indicated by the arrow 33 about a center 0 (FIG. 2).

A tensioning means is also provided in the picking mechanism for stressing the torsion bar 1 in a direction away from the picking direction. This tensioning means includes a cam disc 8 which is fixed to a sleeve 9 and is freely rotatable about the drive shaft 10. As shown, the cam disc 8 is positioned to engage the roller 7 mounted on the lever 3. The tensioning means also has a unilaterally acting clutch (a dog clutch) formed of a driving half 12 mounted on the shaft 10 via a sleeve 32 and a driven half 11 mounted on the end of the sleeve 9.

As shown in FIG. 2, the cam disc 8 has a series of cam sections for sequentially engaging the lever 3 to initially prestress the torsion bar 2, to accelerate the movement of the lever 3 in the picking direction and to partially prestress the torsion bar 1.

In addition, the picking mechanism includes a non-return means for preventing counter-rotation of the cam disc 8. This means includes a ratchet wheel 13 which is mounted in the frame 2 about the sleeve 9 and which includes inclined surfaces in which rolling elements 14 (ratchet rollers) are mounted. The ratchet wheel 13 and rolling elements 14 cooperate so that the sleeve 9 and cam disc can rotate only in the direction indicated by the arrow 33 and not in the opposite direction.

In operation, the lever 3 is held in contact with the cam disc 8 via the roller 7 and the stressed torsion rod 1.

Figure 3:
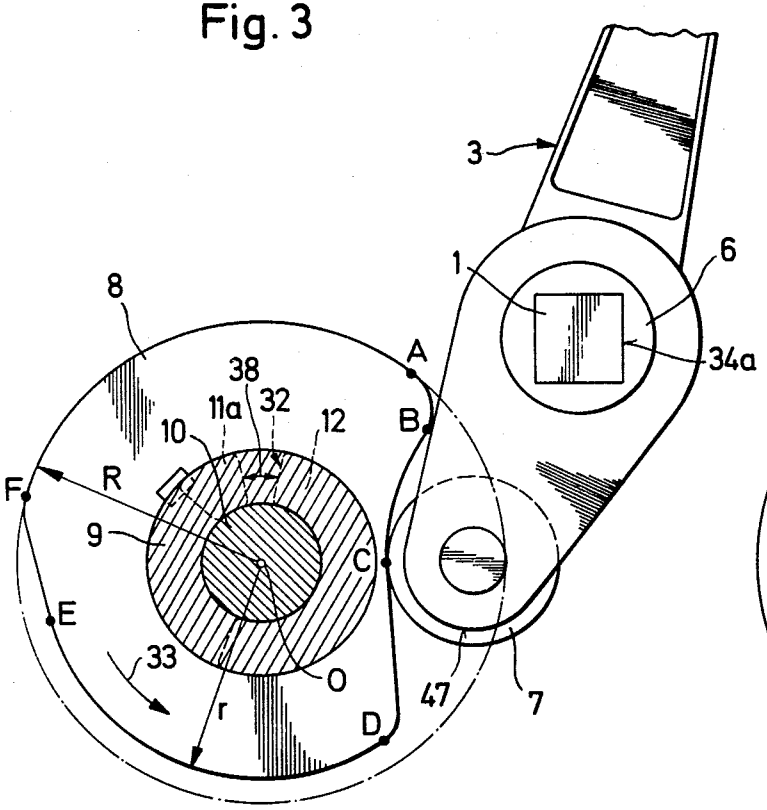
FIG. 3 illustrates a view of the same section as FIG. 2 showing the parts in a different position.

During weaving, the end 34*a* of the torsion rod 1 is turned in the direction indicated by the arrow 37 (FIG. 2) by the circular projection (tensioning or stressing cam section) F-A of the cam disc 8 which has a radius R. The torsion rod 1 is thus twisted and tensioned. The picking lever 3 is in the rear position shown in FIGS. 1 and 2 just before picking starts. In the next picking section A-B of the complete depression A-D, which section slopes away steeply, the picking lever 3 and the shuttle 5 are accelerated (arrows 37*a*, 37*b* representing the picking and insertion of the weft 36). In the section B-C, which has a smaller gradient, the picking lever 3 is decelerated, rotational energy being transmitted from the torsion rod 1 to the disc 8, so that the disc 8 is accelerated to the lowest point C. The driven clutch half 11 then moves, over the uniformly rotating clutch half 12, into the position 11*a* shown in FIG. 3. A clearance 38 thus forms between the two clutch halves 11, 12.

On further rotation of the parts, rotational energy is transmitted from the disc 8 to the torsion rod 1 in the energy re-transmission section C-D while the disc 8 is braked. The rod 1 is again twisted in the direction indicated by the arrow 37, so that the rod 1 is again partially tensioned. The next circular section D-E has a radium r so much smaller than the tension section F-A that the roller 7 can at least roll thereon as far as point D and the disc 8 stops between D and E or rotates more slowly than the shaft 10.

The driving clutch half 12 can now catch up with the driven clutch half 11, come into contact with clutch half 11 and rotate the disc 8 further. In the sloping section E-F, the energy required for complete tensioning of the torsion rod 1 is fed from the cam drive. This energy corresponds to the kinetic energy transmitted to the shuttle 5 on the last pick. The parts are again back in the initial position shown in FIGS. 1 and 2 and are ready for the next pick.

If, due to increased energy being expended on the pick, e.g. due to increased friction of the shuttle 5 or the like, the energy transmitted in section B-C of disc 8 is not sufficient to allow the roller 7 to run on as far as D in the next section C-D, the non-return device 13-15 ensures that the disc 8 cannot follow its tendency to reverse, drawing torsional energy from the torsion bar 1. Instead, the disc 8 stops, e.g. at point $D_1$, until the driving clutch half 12 meets the driven clutch half 11 and causes the disc 8 to rotate further.

Figure 4:
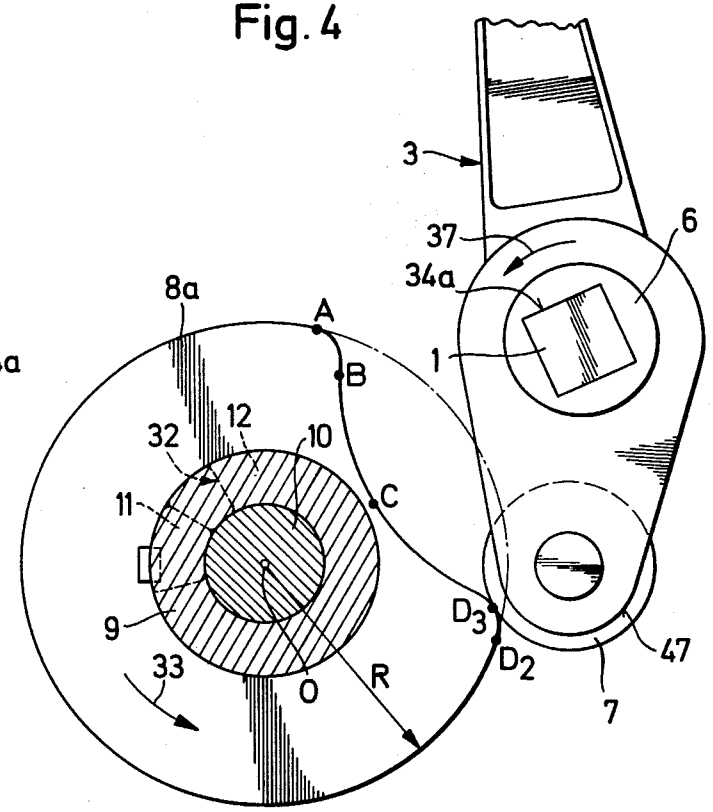
FIG. 4 illustrates a view similar to FIG. 3 of a modified embodiment according to the invention.

Referring to FIG. 4, the cam disc 8*a* may be modified such that the point $D_2$ is situated on the same radius R as point A. The roller 7 must therefore stop, for example, as early as point $D_3$ unless the driving clutch half 12 catches up with the driven clutch half 11 and the clutch half 11 is rotated further. The disc 8*a* does not have a section corresponding to D-E with the smaller radius r in front of the loss energy transmission section E-F according to FIGS. 2 and 3 for the roller 7 to reach and prevent the return movement. Nevertheless, the disc 8 cannot turn back from the stop position $D_3$ shown in FIG. 4, because of the non-return means 13-15.

Figure 5:
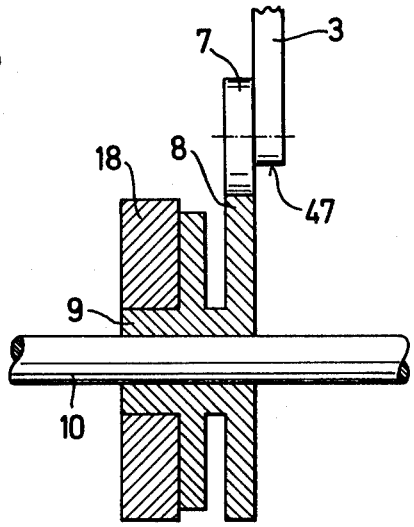
FIG. 5 illustrates a part cross-sectional view of a cam disc with a flyweight in accordance with the invention.

Referring to FIG. 5, a flywheel 18 can be connected to the cam disc 8. The size and effect of the flywheel 18 may be designed for optimum movement.

Figure 6:
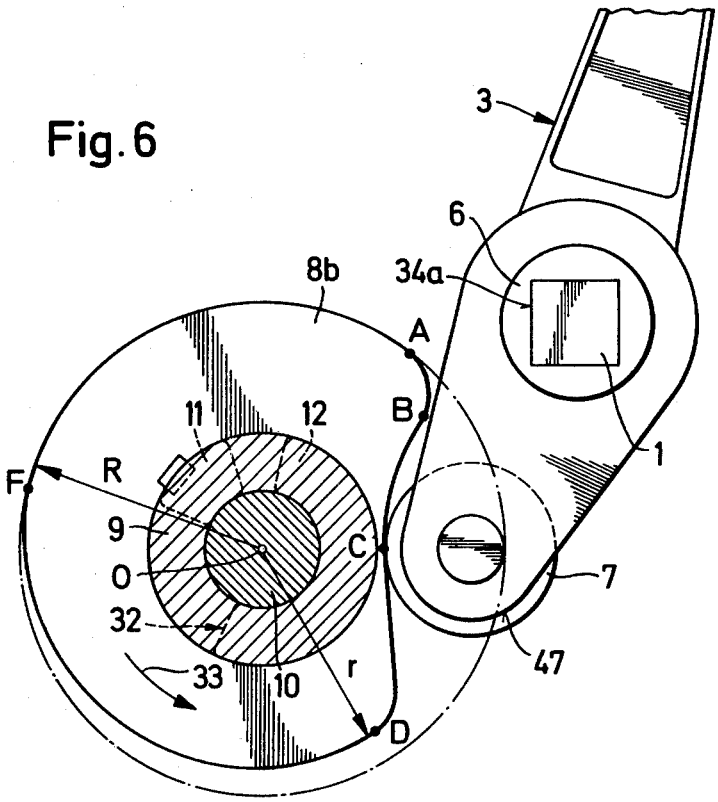
FIG. 6 illustrates a view of a modified cam disc in accordance with the invention.

Referring to FIG. 6, the cam disc 8*b* may alternatively be formed with a slight rise starting from point D with the radius increasing from r to R as far as the top point F in the manner of a spiral. The section D-F forms a self-locking section which acts as a non-return means for the disc 8*b*.

Figure 7:
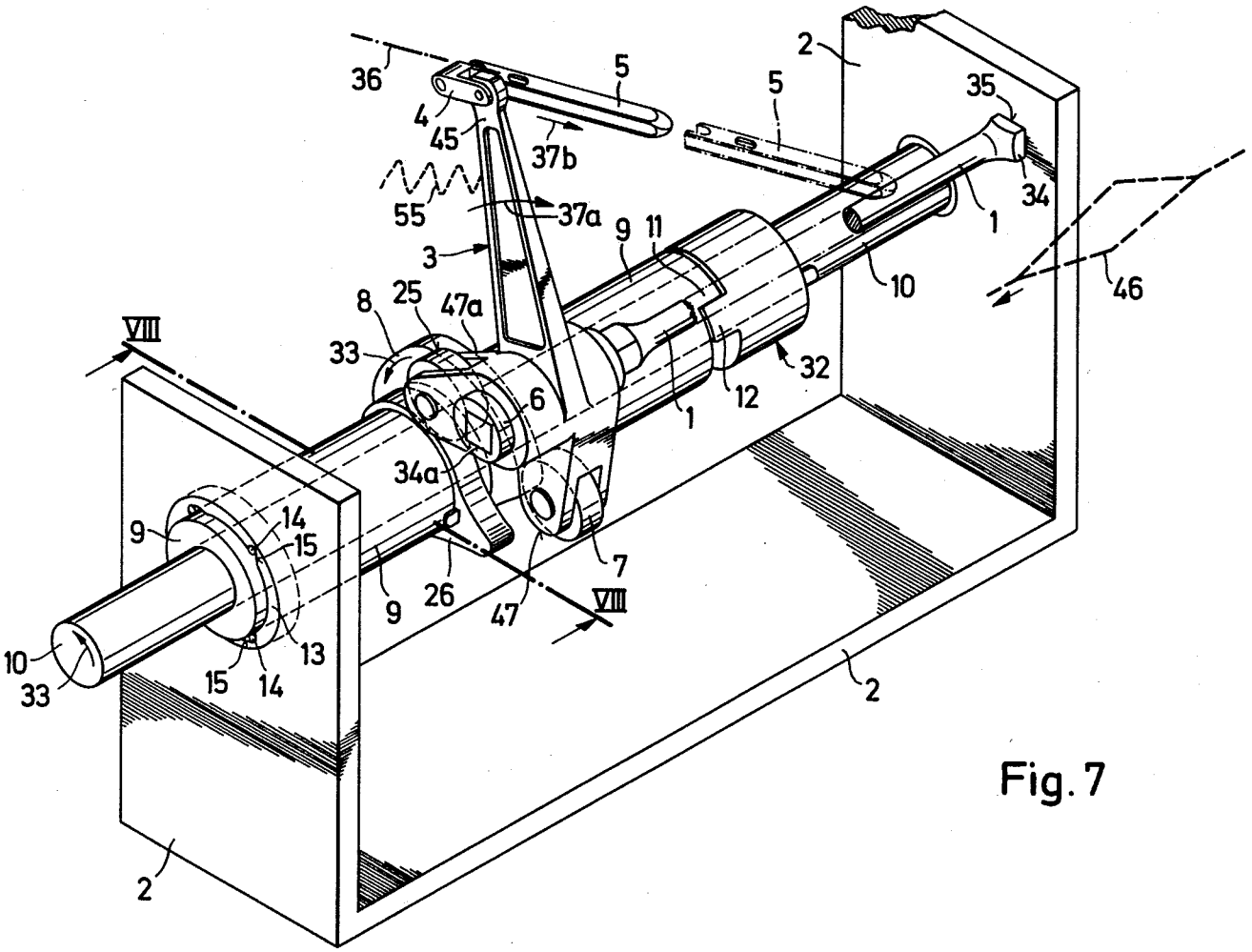
FIG. 7 illustrates a further modified picking mechanism in accordance with the invention.
Figure 8:
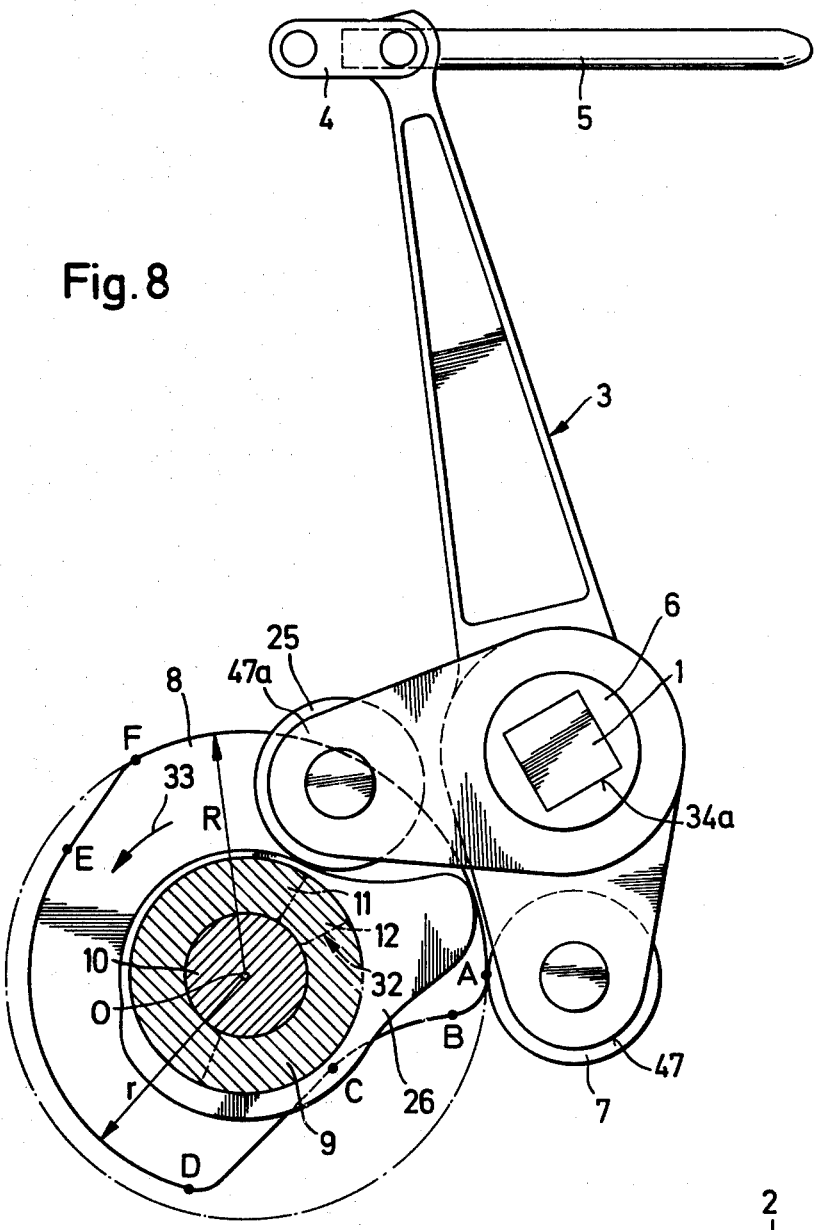
FIG. 8 illustrates a view taken on line VIII—VIII of FIG. 7.

Referring to FIGS. 7 and 8, an arm 47*a* can be secured to the picking lever 3 to project towards the cam disc 8 and can carry an auxiliary roller 25 which co-operates with an auxiliary can disc 26 of complementary construction to the cam disc 8 so that the picking lever 3 is subjected to constraint. As shown, the cam disc 26 is fixedly mounted relative to the cam disc 8 and engages the arm 47*a* to hold the lever 3 against the cam disc 8.

Figure 9:
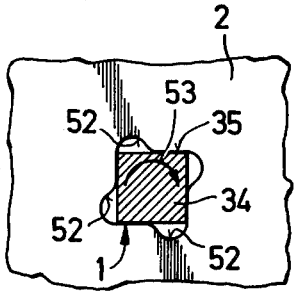
FIG. 9 illustrates a cross-sectional view of a mounting arrangement for a torsion bar in accordance with the invention.

Referring to FIG. 9, the torsion bar 1 can be mounted at the square end 35 for rotation over a certain angle in the direction indicated by the arrow 53 due to the provision of substantially circular recesses 52 in the frame 2 while being held against rotation in the opposite direction. This avoids any torsion in the rod 1 in the opposite direction.

In the examples illustrated, the torsion rod 1 is kept at full tension in each tensioning section F-A; the rod 1 has no tension at point C. The rod is not tensioned in the reverse direction.

The picking mechanism is also suitable, for example, for accelerating shuttles carrying a weft bobbin in automatic looms in which a picking mechanism of this kind will usually be provided on both sides of the shed 46.

Other components to transmit the picking movement, e.g. other levers, toothed segments or the like, may be provided between the picking element 4 and the lever 3 co-operating with the cam disc 8. Instead of the torsion rod 1, a spiral spring 55 shown in broken lines in FIG. 7 and acting on the lever 3 may be provided instead of the torsion bar 1. It is also possible to use a cam disc with an endless slot in which the roller 7 (FIGS. 1 and 2) is positively guided.

Instead of using a depression in the periphery of the cam disc 8 to form the recess A, B, C, D departing from the circle center 0, a projection may be used at the periphery of the cam disc 8 for energy recovery if the tension conditions of the torsion bar 1 are correspondingly reversed.

What is claimed is:

1. A picking mechanism for a shuttle of a weaving machine, said mechanism including a rocking lever;

a picking element mounted on said lever for picking a shuttle;

a spring connected to said lever to bias said lever in a picking direction;

a rotatable drive shaft;

a tensioning means for stressing said spring in a direction away from said picking direction, said means including at least one freely rotatable cam disc mounted on said shaft, a unilaterally acting clutch having a driving half mounted on said shaft for rotation therewith and a driven half secured to said cam disc, said halves being disposed in facing relation to each other, said cam disc having a series of cam sections in engagement with said rocking lever for accelerating the movement of said lever in said picking direction under the bias of said spring during rotation of said shaft while forming a clearance between said clutch halves and for subsequently partially stressing said spring for a subsequent pick; and a non-return means for preventing counter-rotation of said cam disc.

2. A picking mechanism as set forth in claim 1 wherein said non-return means is a self-locking section of said cam disc between said cam section and a following third cam section for full stressing of said spring, said self-locking section having a smaller radius than said third section.

3. A picking mechanism as set forth in claim 2 wherein said self-locking section is circular.

4. A picking mechanism as set forth in claim 2 wherein said self-locking section is a spiral.

5. A picking mechanism as set forth in claim 1 wherein said cam disc includes a sleeve extending about said shaft and said non-return means includes a ratchet wheel disposed about said sleeve and having inclined surfaces, and rolling elements inserted between said inclined surfaces.

6. A picking mechanism as set forth in claim 1 wherein said spring is a torsion bar mounted at one end for rotation in one direction while being held against rotation in an opposite direction.

7. A picking mechanism as set forth in claim 1 which further comprises a flywheel connected to said disc.

8. A picking mechanism as set forth in claim 1 which further comprises an arm secured to and projecting from said lever and a second cam disc fixedly mounted relative to the first cam disc, said second cam disc engaging said arm to hold said lever against said first can disc.

9. A picking mechanism comprising a picking lever having a picking element mounted thereon for picking a shuttle;

a spring for biasing said lever in a picking direction;

a rotatable drive shaft;

a cam shaft freely rotatably mounted on said shaft in engagement with said lever, said cam disc having a series of cam sections thereon for sequentially engaging said lever to initially prestress said spring, to then accelerate the movement of said lever in said picking direction, to then decelerate said lever while rotational energy is transmitted from said spring to said disc and to then partially prestress said spring; and a unilaterally acting clutch between said drive shaft and said cam disc for driving said cam disc off said drive shaft, said clutch being disengaged during acceleration of said lever in said picking direction.

10. A picking mechanism as set forth in claim 9 wherein said clutch includes a driving half mounted on said shaft and a driven half secured to said cam disc in facing relation to said driving half.

11. A picking mechanism as set forth in claim 9 wherein said spring is a torsion bar.

12. A picking mechanism for a shuttle of a weaving machine, said mechanism including a rocking lever;

a picking element mounted on said lever for picking a shuttle;

a spring connected to said lever to bias said lever in a picking direction;

a rotatable drive shaft;

a tensioning means for stressing said spring in a direction away from said picking direction, said means including at least one freely rotatable cam disc mounted on said shaft, a unilaterally acting clutch having a driving half mounted on said shaft for rotation therewith and a driven half secured to said cam disc, said halves being disposed in facing relation to each other, said cam disc having a series of cam sections in engagement with said rocking lever for accelerating the movement of said lever in said picking direction under the bias of said spring during rotation of said shaft while forming a clearance between said clutch halves and for subsequently partially stressing said spring for a subsequent pick; and an arm secured to and projecting from said lever and a second cam disc fixedly mounted relative to the first cam disc, said second cam disc engaging said arm to hold said lever against said first cam disc.

13. A picking mechanism for a shuttle of a weaving machine, said mechanism including a rocking lever;

a picking element mounted on said lever for picking a shuttle;

a spring connected to said lever for picking a shuttle;

a rotatable drive shaft; and a tensioning means for stressing said spring in a direction away from said picking direction, said means including at least one freely rotatable cam disc mounted on said shaft in engagement with said rocking lever, a unilaterally acting clutch having a driving half mounted on said shaft for rotation therewith and a driven half secured to said cam disc, said halves being disposed in facing relation to each other, said cam disc having a first cam section for accelerating the movement of said lever in said picking direction under the bias of said spring during rotation of said shaft, a second following cam section for decelerating said lever while rotational energy is transmitted from said spring to said disc and a clearance is formed between said clutch halves and a third following cam section for subsequently partially stressing said spring for a subsequent pick.

14. A picking mechanism as set forth in claim 13 which further comprises a non-return means for preventing counter-rotation of said cam disc.

15. A picking mechanism as set forth in claim 14 wherein said non-return means is a self-locking section of said cam disc between said third cam section and a following cam section for full stressing of said spring, said self-locking section having a smaller radius than said following section.

* * * * *

UNITED STATES PATENT AND TRADEMARK OFFICE

CERTIFICATE OF CORRECTION

PATENT NO. : 4,223,703

DATED : September 23, 1980

INVENTOR(S) : Erwin Pfarrwaller

It is certified that error appears in the above—identified patent and that said Letters Patent is hereby corrected as shown below:

Column 3, line 60, change "radium" to --radius--

Column 5,line 62, change "can" to --cam--

Signed and Sealed this

*Thirteenth* Day of *January 1981*

[SEAL]

*Attest:*

SIDNEY A. DIAMOND

*Attesting Officer*

*Commissioner of Patents and Trademarks*